United States Patent [19]

Repas

[11] 4,405,388

[45] Sep. 20, 1983

[54] STRENGTHENING RESPONSE IN COLUMBIUM-CONTAINING HIGH-STRENGTH LOW-ALLOY STEELS

[75] Inventor: Paul E. Repas, Monroeville, Pa.

[73] Assignee: United States Steel Corporation, Pittsburgh, Pa.

[21] Appl. No.: 365,420

[22] Filed: Apr. 5, 1982

[51] Int. Cl.[3] ..... C22C 38/06; C22C 38/12

[52] U.S. Cl. ..... 148/36; 75/123 R; 75/124; 148/12 R

[58] Field of Search ..... 148/36; 75/123

[56] References Cited

U.S. PATENT DOCUMENTS 3,795,506 3/1974 Yamaguchi et al. ..... 75/123 J 4,141,761 2/1979 Abraham et al. ..... 75/123 J

*Primary Examiner*—Veronica O'Keefe

*Attorney, Agent, or Firm*—Arthur J. Greif

[57] ABSTRACT

A high-strength, low-alloy steel sheet containing 0.01 to 0.1 percent C, 0.3 to 1.2 percent Mn, 0.03 to 0.15 percent Cb consistently produces yield strengths ranging from 75 to 100 ksi when the potential for placing and maintaining the Cb in solution in austenite is maximized, by adding sufficient titanium to combine with the nitrogen in the steel. The amounts of titanium employed, i.e. 0.010 to 0.045 percent, are substantially leaner than heretofore thought necessary to achieve such high yield strengths.

7 Claims, 1 Drawing Figure

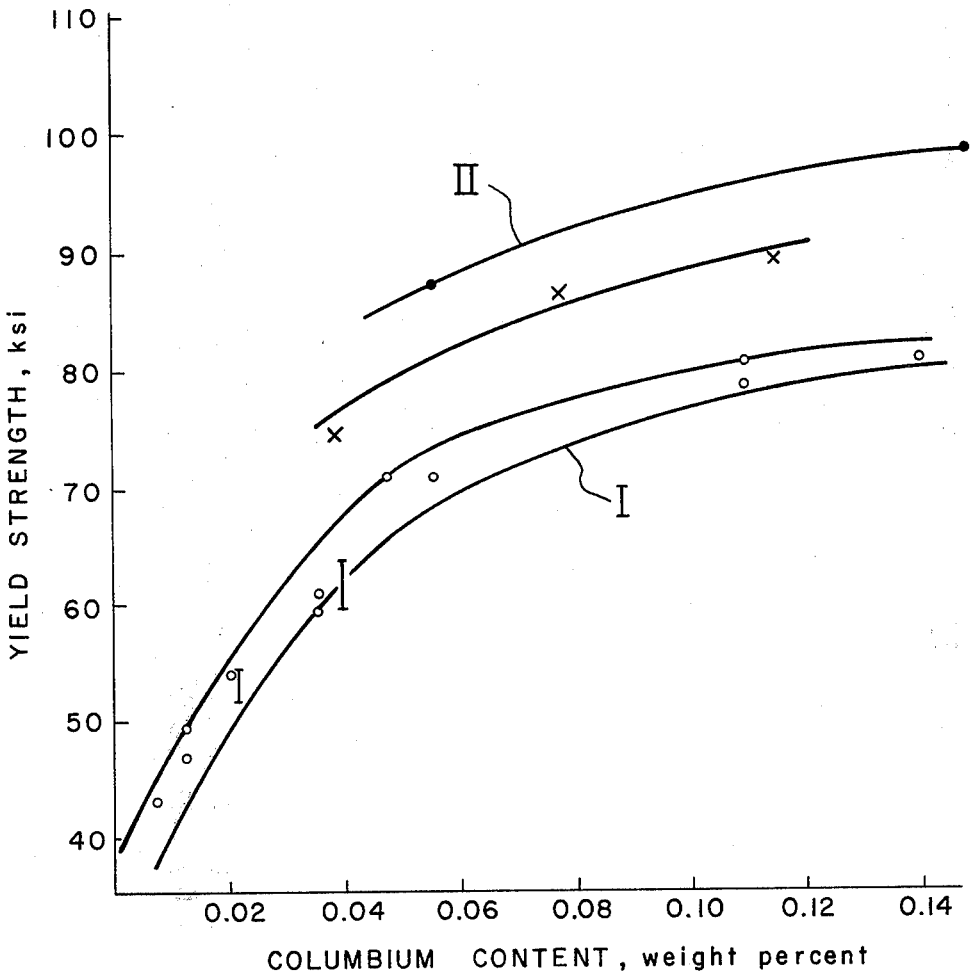
110
100
90
80
70
60
50
40
YIELD STRENGTH, ksi
II
I
0.02
0.04
0.06
0.08
0.10
0.12
0.14
COLUMBIUM CONTENT, weight percent

STRENGTHENING RESPONSE IN COLUMBIUM-CONTAINING HIGH-STRENGTH LOW-ALLOY STEELS

In the production of high-strength, low-alloy steels, Cb, Ti, Zr and V have been employed at various levels and in various combinations. In the production of C-Mn base steels to meet a specified minimum yield strength, it is desirable to use as lean a steel composition as possible to attain the specified requirement. However, in attempting to reduce the amount of alloy additions required, it was found that the strengths attained, as a result of minor variations in processing conditions, were quite inconsistent. To improve such consistency, the art has employed, for example, (i) Cb, Ti and Zr in combination, as shown in U.S. Pat. No. 3,795,506, or (ii) specified minimums of both Cb and Ti as shown in U.S. Pat. No. 4,141,761. A study was conducted of various C-Mn base systems to determine the effect on yield strength, of both substitutional and interstitial elements, and the effect of processing conditions such as slab drop-out temperatures, finishing temperatures and coiling temperatures. It was discovered that the variations in yield strength encountered were, to a significant extent, directly related to the changes in the solubility of columbium carbide as a function of (a) carbon and columbium content and of (b) slab heating temperature and the subsequent precipitation of columbium compounds during hot rolling—in turn controlling the availability of columbium for precipitation hardening of the ferrite. It was therefore postulated, because of the relatively low solubiity of columbium-carbide and nitride in austenite, and because only that columbium which is soluble in austenite can contribute to subsequent precipitation hardening of ferrite; that if the solubility of columbium in austenite at standard slab-heating temperatures could be increased by using low carbon contents and by removing nitrogen from solid solution, attainment of requisite yield strengths could be achieved with leaner compositions than heretofore thought possible, i.e., necessitating only that amount of titanium required to preferentially combine with the nitrogen in the steel.

These and other advantages of the instant invention will become more apparent from a reading of the following description when taken in conjunction with the appended claims and the drawing in which:

The FIGURE is a graphical depiction of the effect of columbium content on yield strength.

U.S. Pat. No. 4,141,761, the disclosure of which is incorporated herein by reference, is directed to the production of a high-strength, low-alloy sheet wherein requisite minimum yield strengths are achieved with a combination of alloying ingredients—utilizing lean amounts of carbon and manganese and moderate amounts of columbium and titanium. Thus, this patent teaches that the assurance of yield strengths of 70, 80 and 90 ksi respectively in hot-rolled products will be achieved when the total of columbium and titanium is at least 0.11, 0.14 and 0.16, respectively. For example, the minimum combined total of 0.11%, required for the achievement of 70 ksi yield strength is obtained by employing at least 0.06% Ti and at least 0.05% Cb. Somewhat contrary to the teachings of this patent, it was found that minimally assured yield strength, rather than being basically dependent on the total concentration of columbium and titanium, was more directly related to changes in solubility of columbium carbide in austenite. Thus, it was found that some titanium is necessary preferentially to combine with the nitrogen in the steel and thereby prevent columbium nitride formation; whereby the absence of such nitrides would permit easier dissolution of the columbium in the austenite and minimize precipitation of columbium compounds during hot rolling, so that a greater fraction of the total columbium is available for precipitation hardening of the ferrite. It may therefore be seen why the four specific steel compositions disclosed in the U.S. Pat. No. 4,141,761 were, in fact, capable of providing the requisite yield strengths since such compositions contained (i) from 0.08 to 0.14% Ti—well in excess of the amount required to combine with the 0.005% N present in such steels, and (ii) from 0.05 to 0.10% Cb, which is "primarily" responsible for the yield strengths attained. This "primary" effect of columbium content is illustrated in the FIGURE, wherein the strengths attained in various hot-rolled sheet products [containing alloying additions outside (band I) and within (band II) the scope of this invention] are plotted as a function of Cb content.

For purposes of comparison, band I shows the representative strengths obtained in a variety of prior art, production-rolled, columbium containing steels having no purposeful addition of titanium. The salient compositional and processing conditions for these prior art steels are listed in Table I below.

TABLE I

Salient Features of Production-Rolled Cb-Containing Steels Without Ti

| Ex. No. | C | Mn | Si | Al | Cb | Coiling Temp. (°F.) | Y.S. (Ksi) | U.T.S. (Ksi) | Elong. in 2 In. (%) |
|---|---|---|---|---|---|---|---|---|---|
| 1-a | 0.08 | 0.39 | 0.014 | 0.065 | 0.000 | 1150 | 35.0 | 51.0 | 38 |
| b | 0.08 | 0.39 | 0.014 | 0.065 | 0.008 | 1175 | 43.3 | 58.2 | 33 |
| c | 0.08 | 0.39 | 0.014 | 0.065 | 0.013 | 1175 | 49.6 | 63.4 | 31 |
| d | 0.06 | 0.35 | 0.018 | 0.054 | 0.013 | 1200 | 46.9 | 59.1 | 32 |
| e | 0.06 | 0.35 | 0.018 | 0.054 | 0.021 | 1200 | 54.2 | 66.1 | 28 |
| 2 | 0.07 | 0.43 | 0.020 | 0.10 | 0.022 | 1195–1230 | 51.8–54.6(i) | 62.9–65.0 | 28.0–34.0 |
| 3-a | 0.05 | 0.41 | 0.023 | 0.10 | 0.036 | 1150 | 59.7 | 70.3 | 29.0 |
| b | 0.05 | 0.41 | 0.023 | 0.11 | 0.036 | 1150 | 61.2 | 72.1 | 25.0 |
| 4 | 0.09 | 0.64 | 0.027 | 0.09 | 0.040 | 1150–1225 | 59.7–63.8(ii) | 71.9–76.7 | 26.5–30.0 |
| 5 | 0.10 | 0.67 | 0.021 | 0.07 | 0.048 | 1200 | 71.0 | 83.8 | 24.0 |
| 6-a | 0.06 | 0.52 | 0.14 | 0.13 | 0.11 | 1100 | 78.9 | 90.6 | 23.0 |
| b | 0.06 | 0.52 | 0.14 | 0.13 | 0.11 | 1000 | 80.8 | 91.2 | 22.0 |
| 7 | 0.007 | 0.71 | 0.037 | 0.086 | 0.14 | 1125 | 81.2 | 93.5 | 23.3 |

TABLE I-continued

| Ex. No. | C | Mn | Si | Al | Cb | Coiling Temp. (°F.) | Y.S. (Ksi) | U.T.S. (Ksi) | Elong. in 2 In. (%) |
|---|---|---|---|---|---|---|---|---|---|
| | | | | Salient Features of Production-Rolled Cb-Containing Steels Without Ti | | | | | |
| 8 | 0.078 | 0.72 | 0.032 | 0.085 | 0.056 | 1175 | 71.1 | 83.0 | 24.5 |

(i)ten tests from 5 coils
(ii)four tests from 2 coils

Band II of the FIGURE shows the strengths as a function of Cb-content, in hot-rolled products containing (except for example 13) a sufficient amount of Ti (i.e. wt. % ratio>3.42:1) to combine with all the nitrogen in the steel at temperatures in the range 2000° to 2300° F. The top curve (examples 9 and 10) represents two different sheet products, production-rolled from commercial size (~200 ton) heats, while the bottom curve (examples 11–13) represents three products produced from laboratory size ingots (135 kg) and processed to simulate production conditions. The salient compositional and processing conditions for these invention steels are listed in Table II below.

TABLE II

| Ex. No. | C | Mn | Si | Al | Cb | N | Ti | Coiling Temp. (°F.) | Y.S. (Ksi) | U.T.S. (Ksi) | Elong. in 2 In. (%) |
|---|---|---|---|---|---|---|---|---|---|---|---|
| | | | | Salient Features of Invention Steels | | | | | | | |
| 9 | 0.075 | 0.70 | 0.031 | 0.079 | 0.056 | 0.007 | 0.043 | 1090 | 87.4 | 99.2 | 21.3 |
| 10 | 0.077 | 0.73 | 0.035 | 0.085 | 0.15 | 0.007 | 0.043 | 1125 | 98.8 | 110.1 | 20.3 |
| 11 | 0.035 | 1.17 | 0.01 | 0.040 | 0.039 | 0.006 | 0.029 | 1100 | 74.8 | 81.9 | 22.8 |
| 12 | 0.034 | 1.17 | 0.01 | 0.043 | 0.078 | 0.007 | 0.029 | 1100 | 86.8 | 91.8 | 19.8 |
| 13 | 0.036 | 1.17 | 0.01 | 0.036 | 0.115 | 0.009 | 0.028 | 1100 | 89.6 | 94.9 | 20.8 |

It may be seen, within the examples represented in the FIGURE, that while the yield strength attained is sensitive to such parameters as slab drop-out temperature, finishing temperature, coiling temperature, manganese content and carbon content, the "primary" independent variable is columbium content, and that as long as there is sufficient titanium to combine with the nitrogen in the steel, increases in strength can be achieved by columbium addition, rather than by addition of both columbium and titanium.

The processing conditions taught in the U.S. Pat. No. 4,141,761 will generally be applicable to the instant invention, with the proviso that hot strip mill rolling procedures (as compared to controlled rolling) have been found to be highly desirable for achieving desired strength levels.

Carbon contents may range from 0.01 to 0.10%, the lower limit being that required to combine at least stoichiometrically, preferably in excess (i.e., Cb/C<7.74), with the columbium present, and the upper limit being imposed by the solubility product $[K=(C)\times(Cb)]$ at the slab heating temperature utilized prior to rolling. For most steelmaking practices, carbon will be in excess of 0.03%. To insure against the softening attendant the precipitation during hot-rolling of columbium carbides, carbon should preferably be limited to a maximum of 0.08%.

Maximum columbium content is dictated by the solubility product mentioned above and will generally be limited to 0.15%. The lower limit is dictated by the minimum strength level required in the final product—the relationship between yield strength and columbium content being shown in the FIGURE. Thus, for the steels in question wherein it is desired to achieve strength levels in excess of 75 ksi, the minimum columbium content will be 0.03%.

Manganese contents can vary from 0.3 to 1.2%, with the optimum value depending on the cooling rate (and therefore the thickness) after hot rolling (before coiling) and will be governed by the continuous cooling transformation characteristics of the steel. Manganese contents near the high end of the range, i.e. 0.8 to 1.0%, may be required to increase hardenability as cooling rates after rolling are decreased. For thicker product, i.e. products having a thickness of 0.25 to 0.40 inches, manganese contents of 0.8 to 1.2% may be required to achieve requisite hardenability; whereas for sheet product having a thickness of less than 0.25 inches, a manganese content less than 0.8%, generally less than 0.6%, will generally suffice.

Phosphorus and sulfur levels should be typical of good steelmaking practices and should generally be below 0.025% for each of these elements. Desulfurization and/or sulfide shape control practices may be used where maximum formability is desired.

Silicon should be maintained as low as practical below 0.10% and should preferably be below 0.04%. Silicon is known to raise the austenite to ferrite transformation temperature and thereby lead both to reduced columbium carbide precipitation strengthening and reduced grain refinement. Excessive amounts of silicon may also lead to development of undesirable surface oxides that are difficult to remove and which may lead to subsequent processing problems.

Zirconium could be used in place of titanium to form stable nitrides, but about twice as much zirconium would be required, on a weight percent basis; and in accord with the economic objectives of this invention, zirconium should be limited to a maximum of 0.05%. Preferably, the sum of titanium and zirconium will be less than 0.05%.

Vanadium, which is known to provide enhanced strengthening in ferrite (vanadium nitride is known to be an effective precipitation strengthener) was found to be an inefficient use of alloying addition in the columbium-titanium steels of this invention. Titanium additions in accord with this invention have been found most effective in increasing strength at low vanadium levels (less than 0.05%). While titanium protects the columbium from forming nitrides at all vanadium levels, the depletion of nitrogen from solid solution appears to decrease the precipitation-strengthening response of vanadium compounds in ferrite. Thus, in accord with the economic objectives of this invention, vanadium will desirably be employed in amounts less than 0.05%. Preferably, the sum of titanium plus vanadium will be less than 0.06%.

Aluminum levels should be adequate to insure good deoxidation and thereby protect the titanium addition from oxidation, so that it is available for nitride formation. Aluminum levels in excess of 0.1% will generally not be required and levels of 0.02 to 0.07% will generally be adequate.

For most steelmaking practices, nitrogen contents will lie in the range of 0.003 to 0.010%, with a maximum of 0.007% being preferred. In accord with the teachings of this invention, it is desirable that the titanium content be greater than 3.42 times (preferably 4 times) the nitrogen content (when titanium and nitrogen are expressed in weight percent) of the steel. Thus, to achieve the minimum desired ratio of titanium to nitrogen, the titanium content of the steel will range from 0.010 to 0.034% for maximum economy, but titanium may be employed up to 0.045%. If special precautions are taken so as to reduce the nitrogen content, i.e. to as low as 0.001%, the titanium content should nevertheless not be decreased below said 0.010% level. Otherwise, TiN could be taken back into solution during heating, thereby risking the precipitation of CbN in austenite during rolling—negating the benefit of this invention. To minimize such TiN dissolution, it is also desirable that slab heating temperatures be limited to a value at which the solubility product $[(Ti)\times(N)]$ is $\leqq 10^{-6}$.

It should be noted, that the desired ratio of titanium to nitrogen is predicated on the desire to eliminate any free nitrogen, to assure attainment of requisite high strength levels. In addition to example 13, other laboratory tests, not reported in the previous tables, employed titanium levels of about three times the nitrogen content, i.e. insufficient to combine with all the nitrogen present. Although the yield strengths in these steels fell below those of band II, they were nevertheless superior to those attained in steels without any titanium addition, i.e. those of band I. Therefore, although not a preferred practice, it is nevertheless considered within the scope of this invention to employ titanium to nitrogen ratios somewhat less than that required stoichiometrically to combine with all the nitrogen in the steel.

I claim:

1. A hot-rolled, aluminum-killed steel product having a thickness less than 0.40 inches and exhibiting a yield strength in excess of 75 ksi, consisting essentially of 0.01 to 0.10% C, 0.03 to 0.15% Cb in an amount wherein Cb<7.74 times the C content of the steel, 0.30 to 1.20% Mn, 0.02 to 0.15% Al, 0.003 to 0.010% N, 0.010 to 0.045% Ti in an amount≧3 times the N content of the steel, less than 0.05% Zr, balance Fe.

2. The product of claim 1, wherein said product is sheet having a thickness less than 0.25 inches and in which Mn is less than 1.00%, Si is less than 0.04%, Al is less than 0.07%, V is less than 0.05%, and Ti≧3.42 times the N content.

3. The sheet of claim 2, in which Mn is less than 0.08%, C is in the range 0.03 to 0.08%, Cb is less than 0.08% and Ti is≧4.0 times the N content, and said yield strength is in excess of 80 ksi.

4. The sheet of claim 3, in which the sum of Ti plus Zr is less than 0.05%.

5. The sheet of claim 4, in which the sum of Ti plus V is less than 0.06%.

6. A hot-rolled, aluminum-killed steel sheet having a yield strength in excess of 75 ksi, consisting essentially of 0.01 to 0.10% C, 0.30 to 1.00% Mn, 0.03 to 0.15% Cb in an amount wherein Cb<7.74 times the C content of the steel, 0.001 to 0.003% N, 0.010 to 0.020% Ti, less than 0.05% Zr, balance Fe.

7. The sheet of claim 6, in which C is in the range 0.03 to 0.08%, Mn is less than 0.8%, Si is less than 0.04%, Al is less than 0.07%, and V is less than 0.05%.

* * * * *